US007096096B2

(12) United States Patent
Kane et al.

(10) Patent No.: US 7,096,096 B2
(45) Date of Patent: Aug. 22, 2006

(54) METHOD AND SYSTEM FOR AUTOMATICALLY LOCATING END OF TRAIN DEVICES

(75) Inventors: Mark Edward Kane, Orange Park, FL (US); James Francis Shockley, Orange Park, FL (US); John D. Mix, Jacksonville Beach, FL (US)

(73) Assignee: Quantum Engineering Inc., Orange Park, FL (US)

( * ) Notice: Subject to any disclaimer, the term of this patent is extended or adjusted under 35 U.S.C. 154(b) by 0 days.

(21) Appl. No.: 10/611,279

(22) Filed: Jul. 2, 2003

(65) Prior Publication Data

US 2005/0004722 A1 Jan. 6, 2005

(51) Int. Cl.
*G05D 1/00* (2006.01)

(52) U.S. Cl. ..... 701/19; 701/20; 701/29; 701/30; 246/122 R; 246/169 R

(58) Field of Classification Search ..... 701/19–20, 701/29–35, 207–213; 246/122 R, 169 R, 246/167 R, 182 R, 2 R, 3–4, 120–121; 702/158, 702/182 B See application file for complete search history.

(56) References Cited

U.S. PATENT DOCUMENTS

| | | | | |
|---|---|---|---|---|
| 4,181,943 A | | 1/1980 | Mercer, Sr. et al. | |
| 4,459,668 A | | 7/1984 | Inoue et al. | |
| 4,561,057 A | | 12/1985 | Haley, Jr. et al. | |
| 4,711,418 A | | 12/1987 | Aver, Jr. et al. | |
| 5,072,900 A | | 12/1991 | Malon | |
| 5,129,605 A | | 7/1992 | Burns et al. | |
| 5,177,685 A | | 1/1993 | Davis et al. | |
| 5,267,473 A | | 12/1993 | Bezos et al. | 73/129 |
| 5,332,180 A | | 7/1994 | Peterson et al. | |
| 5,340,062 A | | 8/1994 | Heggestad | |
| 5,364,047 A | | 11/1994 | Petit et al. | |
| 5,377,938 A | * | 1/1995 | Bezos et al. | 246/167 R |
| 5,394,333 A | | 2/1995 | Kao | |
| 5,398,894 A | | 3/1995 | Pascoe | |
| 5,452,870 A | | 9/1995 | Heggestad | |
| 5,507,457 A | * | 4/1996 | Kull | 246/169 R |
| 5,533,695 A | | 7/1996 | Heggestad et al. | |
| 5,620,155 A | | 4/1997 | Michalek | |

(Continued)

OTHER PUBLICATIONS

"Testimony of Jolene M. Molitoris, Federal Railroad Adminstrator, U.S. Department of Transportation before the House Committee on Transportation and Infrastructure Subcommittee on Railroads", Federal Railroad Administration, United States Department of Transportation, Apr. 1, 1998.

(Continued)

*Primary Examiner*—Gertrude A. Jeanglaude
(74) *Attorney, Agent, or Firm*—DLA Piper Rudnick; Gray Cary US LLP

(57) ABSTRACT

An end of train unit includes a positioning system such as a GPS receiver and is configured to transmit a message including the EOT unit's location when the EOT unit detects a loss of air pipe pressure and/or it is tipped over and/or a low battery condition is detected. In highly preferred embodiments, the EOT unit periodically re-transmits the message until an acknowledgment message is received. In some embodiments, information from the positioning system is used to create a signal as a substitute for a motion sensor. In other embodiments, information from the positioning system is used to determine the speed of the end of the train. End of train unit tracking is also performed.

44 Claims, 6 Drawing Sheets

U.S. PATENT DOCUMENTS

| | | | | |
|---|---|---|---|---|
| 5,699,986 | A | 12/1997 | Welk | |
| 5,740,547 | A | 4/1998 | Kull et al. | |
| 5,751,569 | A | 5/1998 | Metel et al. | |
| 5,757,291 | A * | 5/1998 | Kull | 340/988 |
| 5,785,283 | A * | 7/1998 | Ehrenberger et al. | 246/62 |
| 5,803,411 | A | 9/1998 | Ackerman et al. | |
| 5,828,979 | A | 10/1998 | Polivka et al. | 701/117 |
| 5,866,811 | A * | 2/1999 | Skantar | 73/121 |
| 5,867,122 | A | 2/1999 | Zahm et al. | |
| 5,944,768 | A | 8/1999 | Ito et al. | |
| 5,950,966 | A | 9/1999 | Hungate et al. | 246/62 |
| 5,978,718 | A | 11/1999 | Kull | 701/19 |
| 5,995,881 | A | 11/1999 | Kull | 701/20 |
| 6,049,745 | A | 4/2000 | Douglas et al. | 701/213 |
| 6,081,769 | A | 6/2000 | Curtis | 702/158 |
| 6,087,950 | A * | 7/2000 | Capan | 340/665 |
| 6,102,340 | A | 8/2000 | Peek et al. | 246/121 |
| 6,112,142 | A | 8/2000 | Shockley et al. | |
| 6,135,396 | A | 10/2000 | Whitfield et al. | 246/182 R |
| 6,179,252 | B1 | 1/2001 | Roop et al. | 246/293 |
| 6,195,600 | B1 * | 2/2001 | Kettle, Jr. | 701/19 |
| 6,218,961 | B1 | 4/2001 | Gross et al. | 340/903 |
| 6,227,625 | B1 * | 5/2001 | Gaughan | 303/15 |
| 6,236,185 | B1 | 5/2001 | Hines et al. | 320/101 |
| 6,311,109 | B1 | 10/2001 | Hawthorne et al. | 701/19 |
| 6,322,025 | B1 | 11/2001 | Colbert et al. | 246/167 R |
| 6,345,233 | B1 | 2/2002 | Erick | 701/301 |
| 6,371,416 | B1 | 4/2002 | Hawthorne | |
| 6,373,403 | B1 | 4/2002 | Korver et al. | |
| 6,374,184 | B1 | 4/2002 | Zahm et al. | 701/213 |
| 6,377,877 | B1 | 4/2002 | Doner | 701/19 |
| 6,397,147 | B1 | 5/2002 | Whitehead | 701/213 |
| 6,421,587 | B1 | 7/2002 | Diana et al. | 701/19 |
| 6,456,937 | B1 | 9/2002 | Doner et al. | 701/213 |
| 6,459,964 | B1 | 10/2002 | Vu et al. | 701/19 |
| 6,459,965 | B1 | 10/2002 | Polivka et al. | 701/19 |
| 6,470,245 | B1 * | 10/2002 | Proulx | 701/19 |
| 6,487,478 | B1 | 11/2002 | Azzaro et al. | 701/24 |
| 6,505,104 | B1 | 1/2003 | Collins | 701/19 |
| 6,609,049 | B1 | 8/2003 | Kane et al. | |
| 6,622,067 | B1 * | 9/2003 | Lovelace et al. | 701/19 |
| 6,865,454 | B1 * | 3/2005 | Kane et al. | 701/19 |
| 2001/0056544 | A1 | 12/2001 | Walker | |
| 2002/0070879 | A1 | 6/2002 | Gazit et al. | |
| 2003/0144772 | A1 * | 7/2003 | Proulx | 701/19 |
| 2003/0222981 | A1 * | 12/2003 | Kisak et al. | 348/148 |
| 2003/0225490 | A1 | 12/2003 | Kane et al. | |
| 2004/0120305 | A1 * | 6/2004 | Aiken et al. | 370/347 |

OTHER PUBLICATIONS

"System Architecture, ATCS Specification 100", May 1995.

"A New World for Communications & Signaling", Progressive Railroading, May 1986.

"Advanced Train Control Gain Momentum", Progressive Railroading, Mar. 1986.

"Railroads Take High Tech in Stride", Progressive Railroading, May 1985.

Lyle, Denise, "Positive Train Control on CSXT", Railway Fuel and Operating Officers Association, Annual Proceedings, 2000.

Lindsey, Ron A., "C B T M, Communications Based Train Management", Railway Fuel and Operating Officers Association, Annual Proceedings, 1999.

Moody, Howard G, "Advanced Train Control Systems A System to Manage Railroad Operations", Railway Fuel and Operating Officers Association, Annual Proceedings, 1993.

Ruegg, G.A., "Advanced Train Control Systems ATCS", Railway Fuel and Operating Officers Association, Annual Proceedings, 1986.

Malone, Frank, "The Gaps Start to Close"Progressive Railroading, May 1987.

"On the Threshold of ATCS", Progressive Railroading, Dec. 1987.

"CP Advances in Train Control", Progressive Railroading, Sep. 1987.

"Communications/Signaling: Vital for dramatic railroad advances", Progressive Railroading, May 1988.

"ATCS'System Engineer", Progressive Railroading, Jul. 1988.

"The Electronic Railroad Emerges", Progressive Railroading, May 1989.

"$C^3$ Comes to the Railroads", Progressive Railroading, Sep. 1989.

"ATCS on Verge of Implementation", Progressive Railroading, Dec. 1989.

"ATCS Evolving on Railroads", Progressive Railroading, Dec. 1992.

"High Tech Advances Keep Railroads Rolling", Progressive Railroading, May 1994.

"FRA Promotes Technology to Avoid Train-To-Train Collisions", Progressive Railroading, Aug. 1994.

"ATCS Moving slowly but Steadily from Lab for Field", Progressive Railroading, Dec. 1994.

Judge, T., "Electronic Advances Keeping Railroads Rolling", Progressive Railroading, Jun. 1995.

"Electronic Advances Improve How Railroads Manage", Progressive Railroading, Dec. 1995.

Judge, T., "BNSF/UP PTS Pilot Advances in Northwest", Progressive Railroading, May 1996.

Foran, P., "Train Control Quandary, Is CBTC viable? Railroads, Suppliers Hope Pilot Projects Provide Clues", Progressive Railroading, Jun. 1997.

"PTS Would've Prevented Silver Spring Crash: NTSB", Progressive Railroading, Jul. 1997.

Foran, p., "A 'Positive' Answer to the Interoperability Call", Progressive Railroading, Sep. 1997.

Foran, P., "How Safe is Safe Enough?", Progressive Railroading, Oct. 1997.

Foran, P., "A Controlling Interest In Interoperability", Progressive Railroading, Apr. 1998.

Derocher, Robert J., "Transit Projects Setting Pace for Train Control", Progressive Railroading, Jun. 1998.

Kube, K., "Variations on a Theme", Progressive Railroading, Dec. 2001.

Kube, K., "Innovation in Inches", Progressive Railroading, Feb. 2002.

Vantuono, W., "New York Leads a Revolution", Railway Age, Sep. 1996.

Vantuono, W., "Do you know where your train is?", Railway Age, Feb. 1996.

Gallamore, R., "The Curtain Rises on the Next Generation", Railway Age, Jul. 1998.

Burke, J., "How R&D is Shaping the 21st Century Railroad", Railway Age, Aug. 1998.

Vantuono, W., "CBTC: A Maturing Technology", Third International Conference On Communications Based Train Control, Railway Age, Jun. 1999.

Sullivan, T., "PTC—Is FRA Pushing Too Hard?", Railway Age, Aug. 1999.

Sullivan, T., "PTC: A Maturing Technology", Railway Age, Apr. 2000.

Moore, W., "How CBTC Can Increase Capacity", Railway Age, Apr. 2001.

Vantuono, W., "CBTC: The Jury is Still Out", Railway Age, Jun. 2001.

Vantuono, W., "New-tech Train Control Takes Off", Railway Age, May 2002.

Union Switch & Signal Intermittent Cab Signal, Bulletin 53, 1998.

GE Harris Product Sheet: "Advanced Systems for Optimizing Rail Performance" and "Advanced Products for Optimizing train Performance", undated.

GE Harris Product Sheet: "Advanced, Satellite-Based Warning System Enhances Operating Safety", undated.
Furman, E., et al., "Keeping Track of RF", GPS World, Feb. 2001.
Department of Transportation Federal Railraod Administration, Federal Register, vol. 66, No. 155, pp. 42352-42396, Aug. 10, 2001.
"Trainlink® ATX (Air Turbine) End of Train Telemetry Device", www.elpasohub.org/ATX.htm as printed May 5, 2003.
www.elpasohub.org/images/Image10.gif as printed Sep. 10, 2004.

* cited by examiner

METHOD AND SYSTEM FOR AUTOMATICALLY LOCATING END OF TRAIN DEVICES

BACKGROUND OF THE INVENTION

1. Field of the Invention

The invention relates generally to railroad end of train units, and more particularly to an improved method for keeping track of end of train units.

2. Discussion of the Background

Within the railroad industry, end of train (EOT) units are typically attached at the rear of the last car on a train. As is well known in the art, these EOT units can perform one or more of a variety of functions. EOT units monitor air pressure in the air brake pipe and transmit this information to the head of the train (HOT). EOT units also often include an end-of-train marker light. Two-way EOT units can accept a command from the HOT to open the air brake pipe (loss of air pressure in the air brake pipe causes the brakes to activate and stop the train) in an emergency situation. Some EOT units include motion detectors that are used to inform the HOT as to whether, and in some cases in which direction, a train is moving. Other EOT units include GPS receivers that are used to transmit location information pertaining to the end of the train to HOT equipment as discussed in U.S. Pat. No. 6,081,769. EOT units usually communicate with the HOT using radio-based communications.

Supplying power to EOT units is an important consideration. As discussed in U.S. Pat. Nos. 5,267,473 and 6,236,185, it is known to supply power to EOT units using batteries or a combination of batteries and air-powered generators connected to the brake pipe. In order to conserve battery power, EOT units are usually configured to power down when the unit is tipped over from a vertical orientation to a horizontal orientation by trainyard personnel when the EOT is not in use.

As their name implies, EOT units are mounted at the end of a train. Because various cars in trains are often shuffled in and out of consists and because trains are often reformed during operation, it is often necessary to install and remove EOT units from individual cars in a train yard. Because EOT units are often heavy and/or bulky, EOT units removed from cars are often left by the wayside for collection at a later time. Unfortunately, EOT units left by the wayside in this manner often become misplaced or "lost." Thousands of wayside units are lost this way each year. Even a temporarily misplaced EOT unit can cost a railroad money. For example, rent must be paid for the time when an EOT unit from one railroad is in another railroad's territory. Thus, if such an EOT unit is temporarily misplaced, the rent is increased.

What is needed is an apparatus and method for tracking EOT units.

BRIEF SUMMARY OF THE INVENTION

The present invention meets the aforementioned need to a great extent by providing an end of train unit that includes a positioning system such as a GPS receiver and that is configured to transmit a message including the EOT unit's location when the EOT unit detects a loss of air pipe pressure, a low battery condition, or when the EOT unit is tipped over or in response to a query from a device located off the train. The EOT unit may communicate directly with a device located off the train. Alternatively, an EOT unit-generated message intended to be received by a device located off the train may be transmitted by the EOT unit to the HOT and re-transmitted by the HOT to the device located off the train.

In highly preferred embodiments, the EOT unit periodically re-transmits the message until an acknowledgment message is received. In such embodiments, the HOT may be configured to detect a situation in which an EOT unit has ceased re-transmitting the message before an acknowledgment message is received, and when such a situation is detected, to begin transmitting a message including the EOT position (which message may be a substantial duplicate of the message transmitted by the EOT unit) until an acknowledgment is detected.

In another aspect of the invention, messages containing EOT unit locations are collected by an EOT unit monitoring station. The EOT unit monitoring station generates a message including the EOT location information and routes the message to appropriate personnel responsible for tracking the EOT units. The EOT unit monitoring station preferably translates the positioning system coordinates from the EOT unit into another set of coordinates (e.g., milepost locations) and/or generates a display in which the EOT unit location is superimposed over a map to aid a human being in locating the device. Preferably, the message from the EOT unit monitoring station to the personnel is repeated until an acknowledgment of the message and/or a confirmation that the EOT unit has been retrieved is received from the personnel.

In some embodiments of the invention, the EOT unit and a device located at the HOT communicate with each other using low power radio communications which cannot travel long distances, but the HOT is also equipped with a long range communication system (e.g., a high power rf or satellite transceiver) that is capable of communicating with devices (e.g., a dispatcher transceiver) located a great distance off the train. In such embodiments, a message including an identification number of a particular EOT unit that is "lost" or whose location is to be determined for any other reason may be sent to one or more (or all) HOT devices via the long range communication system. The HOT devices in turn transmit a query message directed to the lost device via the low power communication system and relay any message received from the lost EOT unit on the low power communication system via the long range communication system. This allows any EOT unit within the range of the short range communications system to be located even if the EOT unit is not connected to any HOT.

In yet another aspect of the invention, information from the positioning system is used to create a signal as a substitute for a motion sensor. In still another aspect, position information from the positioning system is used to determine the speed of the end of the train.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of end of train units. Specific details, such as types of positioning systems and power supply subsystems, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
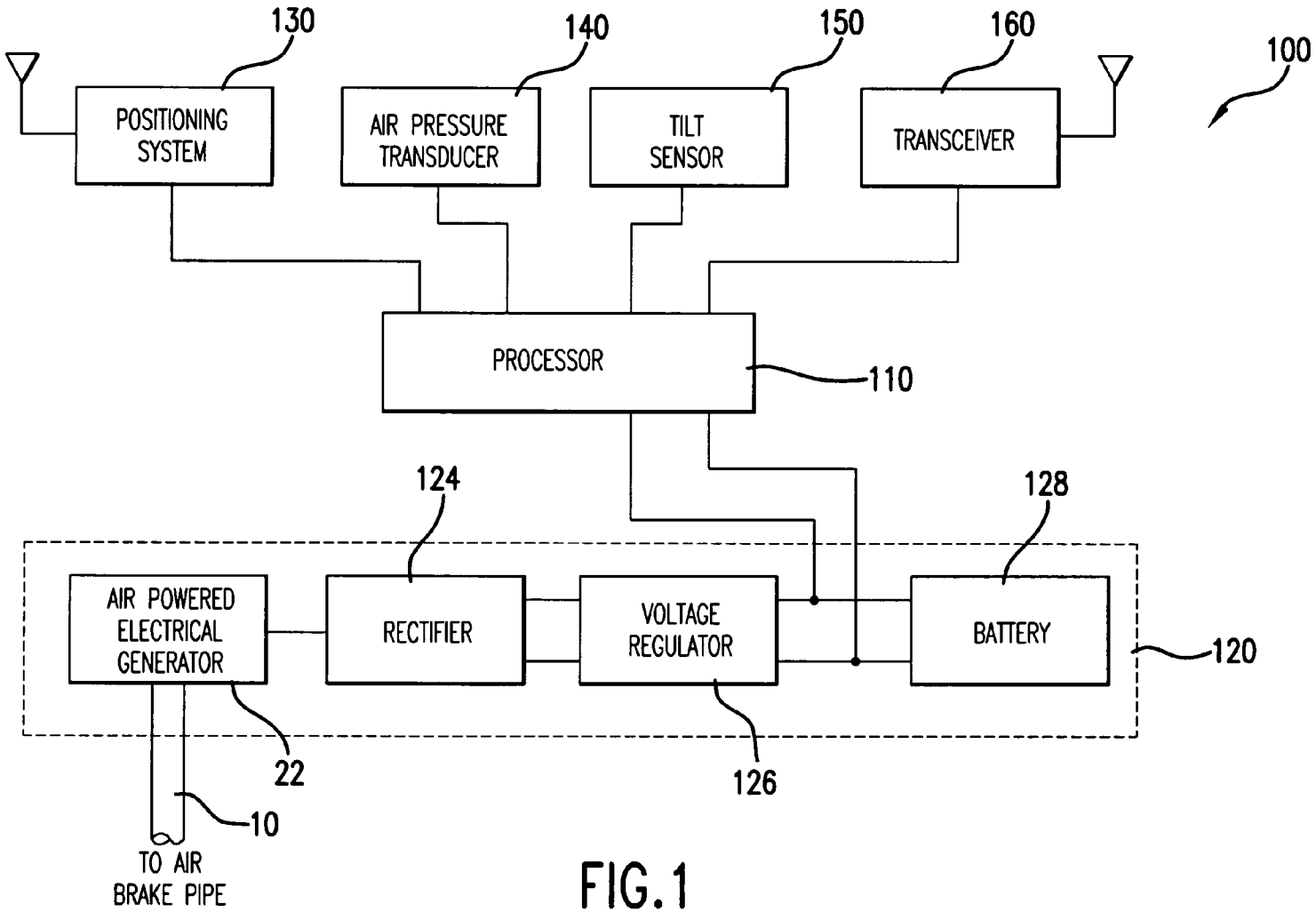
FIG. 1 is a block diagram of an end of train unit according to one embodiment of the invention.

An end of train unit 100 according to one embodiment of the invention is illustrated in FIG. 1. The EOT unit 100 includes a processor 110. The processor 110 may be a microprocessor or may be implemented using discrete components. The processor 110 is responsible for implementing the logical operations discussed in detail below.

The processor 110 receives electrical power from a power supply subsystem 120. The power supply subsystem 120 is substantially the same as that described in U.S. Pat. No. 6,236,185, the contents of which are hereby incorporated herein by reference. The power supply subsystem 120 includes an air-powered electrical generator 122 connected to an air brake pipe 10. The output of the generator 122 is connected to a rectifier 124. The output of the rectifier 124 is connected to a voltage regulator 126 whose output is connected to continuously recharge a rechargeable battery 128 and to supply power to the processor 110. In this manner, if air pressure is lost in the air brake pipe 10, the processor 110 will continue to receive power from the battery 128. It should be noted that a battery alone, an air-powered generator alone, or other types of power subsystems such as those disclosed in U.S. Pat. No. 5,267,473, could be used in place of the power subsystem 120 of FIG. 1. A positioning system 130 is also connected to the processor 110. The positioning system 130 is a GPS receiver in preferred embodiments. The GPS receiver can be of any type, including a differential GPS, or DGPS, receiver. Other types of positioning systems 130, such as inertial navigation systems (INSs), Loran systems, and wheel tachometers, can also be used. Such positioning systems are well known in the art and will not be discussed in further detail herein. [As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that are used to transmit information to the GPS receiver.]

As discussed above, conventional EOT units include a motion detector that allows HOT equipment to detect when the end of the train is in motion. One of the intended uses is to allow the HOT to determine when the end of the train has become uncoupled from the head of the train. In some embodiments of the invention, the positioning system 130 is used in place of a motion detector. In such embodiments, if the positioning system 130 only provides position information, the processor 110 (or other equipment at the HOT) can compare successive positions from the positioning system 130, taking into account known errors in the positioning system 130, to determine whether the end of train is in motion. In embodiments with positioning systems that provide speed information, motion can be detected by monitoring the speed information received from the positioning system 130, again taking into account known errors in the positioning system 130. In some embodiments, a threshold of 1 m.p.h. is used to determine whether or not the train is in motion.

An air pressure transducer 140 is also connected to the processor 110. The air pressure transducer is connected to monitor the air pressure in the air brake pipe 10 (this connection is not shown in FIG. 1). The air pressure information from the transducer 140 is supplied to the HOT in a conventional fashion. As discussed further below, the processor 110 also interprets a loss of air pressure in the air brake pipe 10 and/or an indication that the EOT unit 110 has been tipped over as an indication that the EOT unit is to go out of service and that it may be necessary to begin transmitting the EOT unit's location to an EOT unit monitoring station (not shown in FIG. 1).

As discussed above, conventional EOT units are mounted on the end of the train such that they may be tipped over from a vertical position to a horizontal position when not in service. Preferred embodiments of the invention follow this convention and include a tilt sensor 150 connected to the processor 110. The tilt sensor 150 detects when the EOT unit 100 has been tipped over, such as when the EOT unit 100 has been removed from a car and laid on its side. The processor 110 uses the information from the tilt sensor 150 and/or brake pipe air pressure information from the air pressure transducer 140 to determine when to begin transmitting EOT location information. Although a tilt sensor 150 is used in preferred embodiments, any other device or mechanism, such as a simple on/off switch, can be used in place of the tilt sensor 150 to indicate that the EOT unit is to go out of service.

A transceiver 160 connected to the processor 110 allows for two-way communications between the EOT unit 100 and HOT equipment. Among other things, the transceiver 160 transmits air brake pipe pressure information to HOT equipment and, in some embodiments, receives commands to open the air brake pipe 10 for braking operations from the HOT equipment. In embodiments in which the positioning system 130 replaces a motion detector and in which motion detection processing is performed by the processor 110, the transceiver 160 is also capable of transmitting a message from the processor 110 to the head of the train when the end of the train has begun and/or stopped moving. Additionally, the transceiver 160 is preferably capable of transmitting a message including location information to an EOT unit monitoring station (not shown in FIG. 1) when the processor 110 determines that the EOT unit 100 is to go out of service as will be discussed more fully below or in response to a query from the EOT unit monitoring station which may or may not be associated with a dispatcher. In some embodiments, the transceiver 160 is a short range transceiver such as a two watt radio frequency transceiver. In other embodiments, the transceiver 160 may be suited for long range communications (e.g., a 100 watt radio frequency or satellite transceiver) that may be of the same type used by an HOT device to communicate with a central authority such as a dispatcher.

Figure 2:
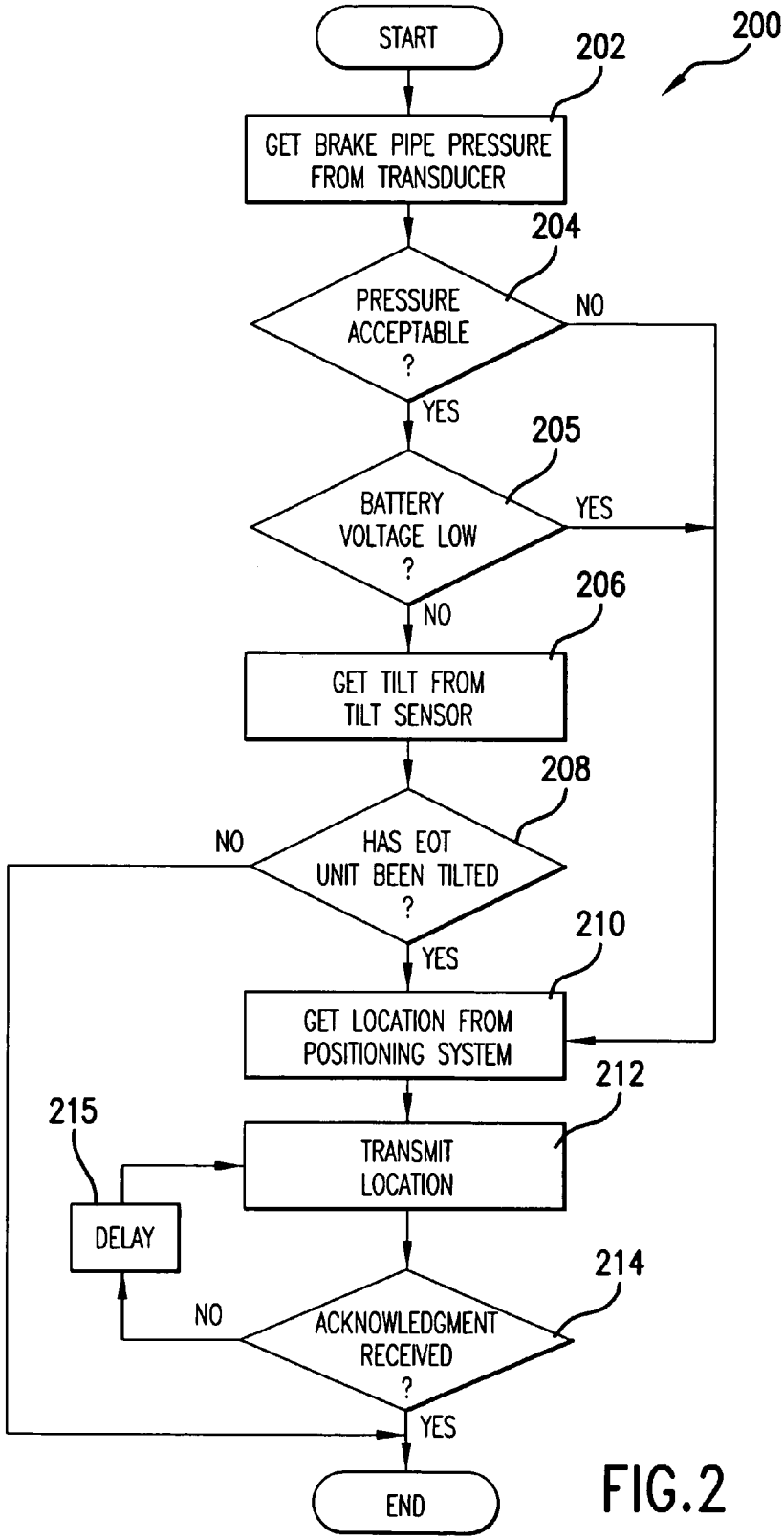
FIG. 2 is a flow chart illustrating a location reporting subroutine performed by the end of train unit of FIG. 1.

A flowchart 200 illustrating a monitoring subroutine performed by the EOT unit 100 is shown in FIG. 2. This monitoring subroutine may be called at a periodic rate, such as once a second. In embodiments of the invention that do not include a power subsystem 120 with a battery 128 but rather are powered solely by an air powered generator, the periodic rate is chosen to ensure that the processor 110 will have sufficient time to transmit at least one location message before power from the air powered generator is lost as a result of a loss of air pressure in the air brake pipe 10. It should be understood that the monitoring subroutine illustrated in the flowchart 200 is only one function performed by the EOT unit 100. Other functions, such as reporting the pressure in the air brake pipe 10, turning marker lights on and off, and responding to braking commands, are also performed in separate subroutines in a conventional manner. These other subroutines will not be discussed in further detail herein.

The processor 110 obtains the air pressure in the air brake pipe 10 from the air pressure transducer 140 at step 202. If the brake pipe pressure is acceptable at step 204, the processor 110 determines whether the battery 128 voltage is acceptable at step 205. In preferred embodiments, the processor 110 includes a built-in A/D converter connected to the battery 128 for this purpose. Alternatively, an external A/D converter (not shown) could be provided for monitoring the battery voltage. If the voltage is acceptable at step 206, the processor 110 queries the tilt sensor 150 at step 206. If the tilt sensor 150 indicates that the EOT unit 100 has not been tipped over at step 208, the subroutine ends.

If the brake pipe pressure is not acceptable at step 204 or if the battery voltage is low at step 205 or if the EOT unit 100 has been tipped over at step 208, the processor 110 obtains the current location of the EOT unit 100 from the positioning system 130 at step 210. The processor 110 then transmits the current location to an EOT tracking station (not shown in FIG. 1) via the transceiver 160 at step 212. If an acknowledgment of the current location message is not received at step 214, the processor 110 delays for a period of time and then re-transmits the current location message at step 212. The subroutine 200 ends when an acknowledgment of the current location message is received at step 214 or when power to the EOT unit 100 is lost.

In the subroutine 200 described above, the processor 110 begins transmitting a location message when either the brake pipe 10 pressure is lost or the battery voltage is low or the EOT unit 100 is tipped over. In other embodiments of the invention, the processor 110 does not begin transmitting the location information until all three conditions are present concurrently or until two or more conditions are present concurrently (e.g., both the brake pipe pressure is lost and the EOT unit 100 is tipped over).

In the embodiment described above, the location message from the end of train unit 100 includes position information from the positioning system, such as latitude and longitude. This information may be translated into a position related to the railroad, such as track number and/or position on the track relative to a landmark such as a milepost, by equipment at the EOT monitoring station. In alternative embodiments, the processor 110 may perform this conversion.

Those of skill in the art will recognize that implementation as a polled subroutine is but one way in which to implement the reporting function described above in connection with the flowchart 200. Any number of other implementations, such as implementation as an interrupt service routine triggered by an interrupt generated by a loss of brake pipe air pressure indication from the transducer 140 and/or a tilt indication from the tilt sensor 150.

The EOT unit 100 is also configured to respond to a query message from an end-of-train unit monitoring station in some embodiments. Such a message might be transmitted at any time, not just when the EOT unit is to go out of service. This feature can be used by the end-of-train unit monitoring station, which may be (but is not necessarily) associated with a dispatcher to keep track of trains in train yards as well as to locate EOT units.

Figure 3:
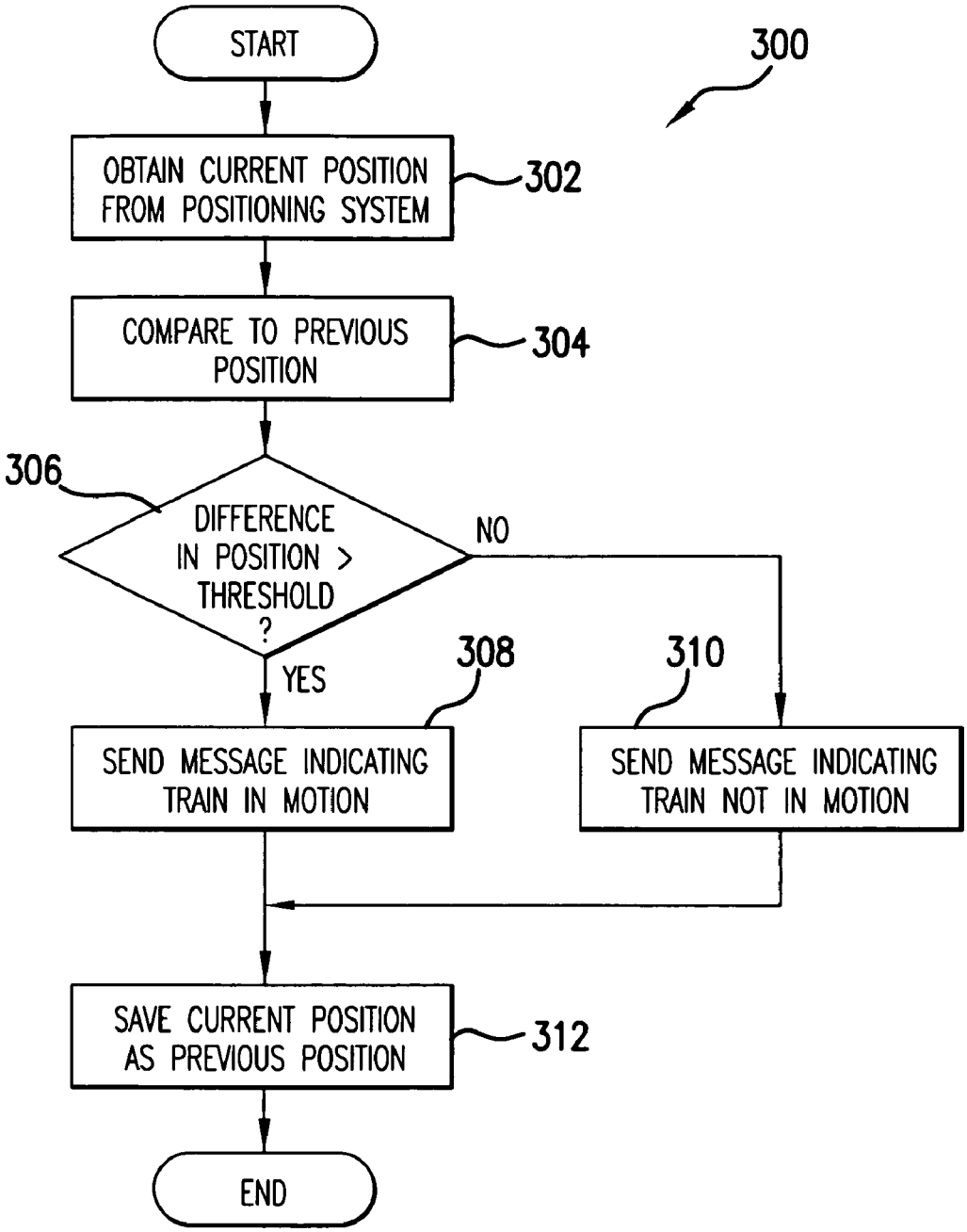
FIG. 3 is a flow chart illustrating operation of a motion sensing subroutine performed by the end of train unit of FIG. 1.

In some embodiments of the invention, the EOT unit 100 also includes a motion sensor (not shown in FIG. 1), and information from the motion sensor is transmitted to the HOT so that the HOT can determine whether or not the train is in motion. Other embodiments of the invention do not include a motion sensor. In such embodiments, the processor 110 uses information from the positioning system 130 to determine motion (or lack thereof) of the end of the train and transmits this information to the HOT via transceiver 160. An example of a subroutine, callable at a periodic rate, that implements this function according to one embodiment of the invention is illustrated by the flowchart 300 of FIG. 3.

The processor 110 obtains the current position of the EOT unit 100 from the positioning system 130 at step 302 and compares this position to the previous position at step 304. The difference between the current and previous positions is compared to a threshold at step 306. The threshold is preferably chosen to take inaccuracies associated with the positioning system into account. If the difference between the current and previous positions is greater than the threshold at step 306, the processor 110 sends a message to the HOT indicating that the train is in motion at step 308. Otherwise, the processor 110 sends a message to the HOT indicating that the train is not in motion at step 310. It should also be noted that these messages may also be sent to an entity off the train, such as a dispatcher. Next, the processor saves the current position as the previous position at step 312 and the subroutine ends.

The subroutine 300 is but one simple manner of implementing a process for using a positioning system 130 in place of a motion sensor. Other, more sophisticated embodiments are also within the scope of the present invention. For example, rather than simply calculating a difference between the current and previous positions, successive differences could be filtered using any variety of known techniques, e.g., Kalman filtering. In other embodiments of the invention, the processor 110 reports not only a simple motion/not in motion indication, but also provides speed information to the HOT and/or an entity not onboard the train, such as a dispatcher. In some of these embodiments, the speed is supplied directly by the positioning system 130; in other embodiments, the speed is calculated by the processor 110 based on filtered successive location reports from the positioning system 130. It should also be noted that the processor 110 may also be configured to turn an EOT marker light on and off based on whether the information from the positioning system indicates that the train is in motion.

Figure 4:
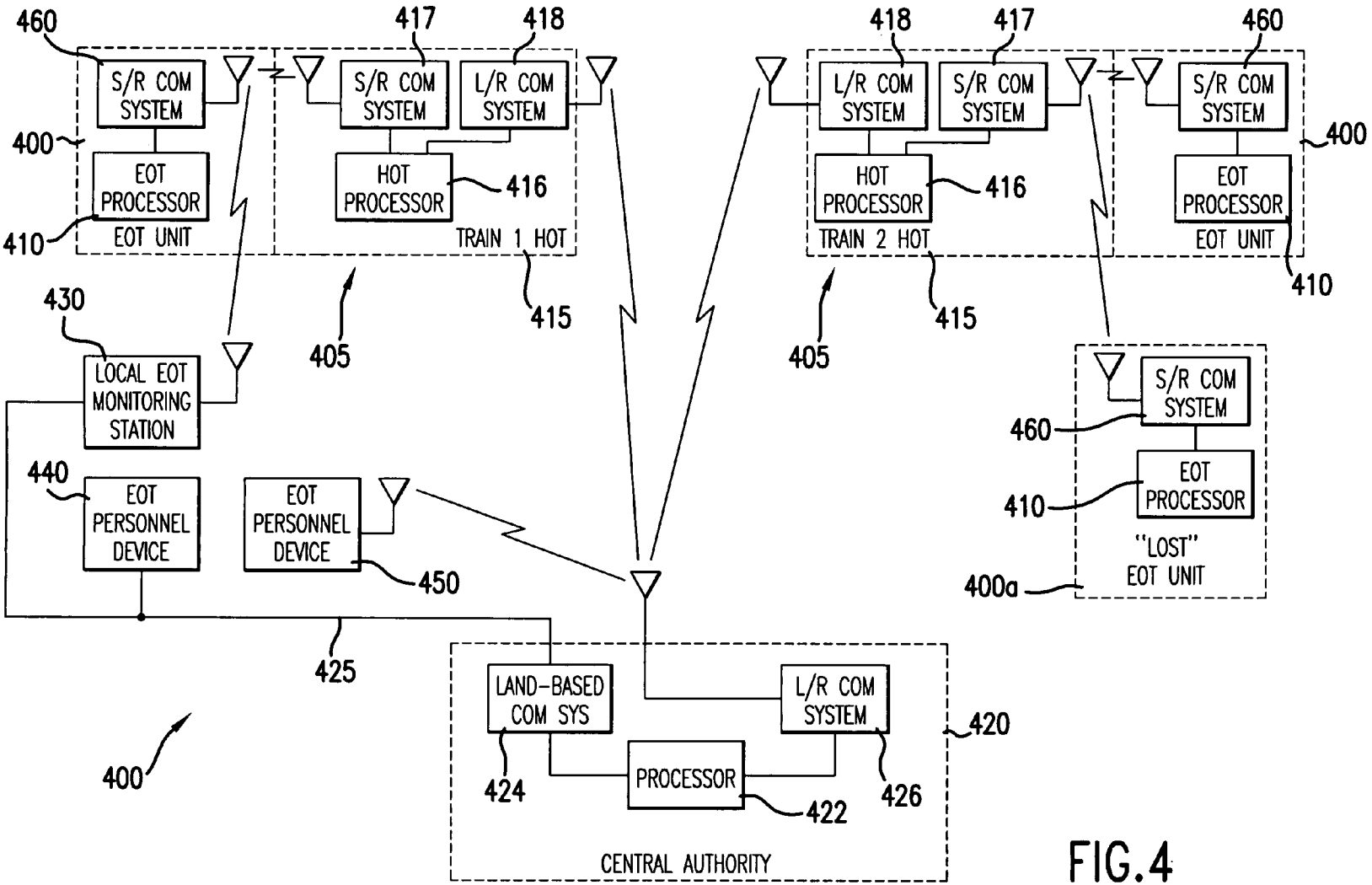
FIG. 4 is a block diagram of a system including an end of train unit according to a further embodiment of the invention.

The EOT unit 100 discussed above is suitable for use in a wide variety of systems. An exemplary system 400 with which the EOT unit 100 may be used is illustrated in FIG. 4. The system 400 includes a plurality of trains 405, each including an EOT unit 400 and an HOT unit 415. The EOT units 400 include EOT processors 410 and short range communications systems 460, which may comprise short range radio frequency transceivers in some embodiments.

Additional components of the EOT units 400, such as the power supply and the positioning system, are not illustrated in FIG. 4 for the sake of clarity. Also shown in FIG. 4 is a lost EOT unit 400*a*, which is not connected to any train.

The HOT units 415 include an HOT processor 416, a short range communications system 417 suitable for communications with the short range communications systems 460 on the EOT units 400, and a long range communications system 418. The long range communications systems 418 may be, for example, a high power RF or satellite transceiver.

Also forming part of the system 400 is a central authority 420, which may perform the role of the EOT unit monitoring station discussed above in some embodiments of the invention. The central authority 420 includes a processor 422, a long range communication system 426 suitable for communicating with the long range communications systems 418 in the HOT devices 415, and a land-based communication system 424.

The land-based communication system 424 is connected to a local EOT monitoring station 430, which includes a communication system compatible with the short range communications systems 460 of the EOT units 400. A first EOT personnel device 440 is also connected to the land-based communications system. A second EOT personnel device 450, which may take the form of a mobile, hand-held device in some embodiments of the invention, includes a communications system compatible with the long range communications system 426 of the central authority 420.

Figure 5:
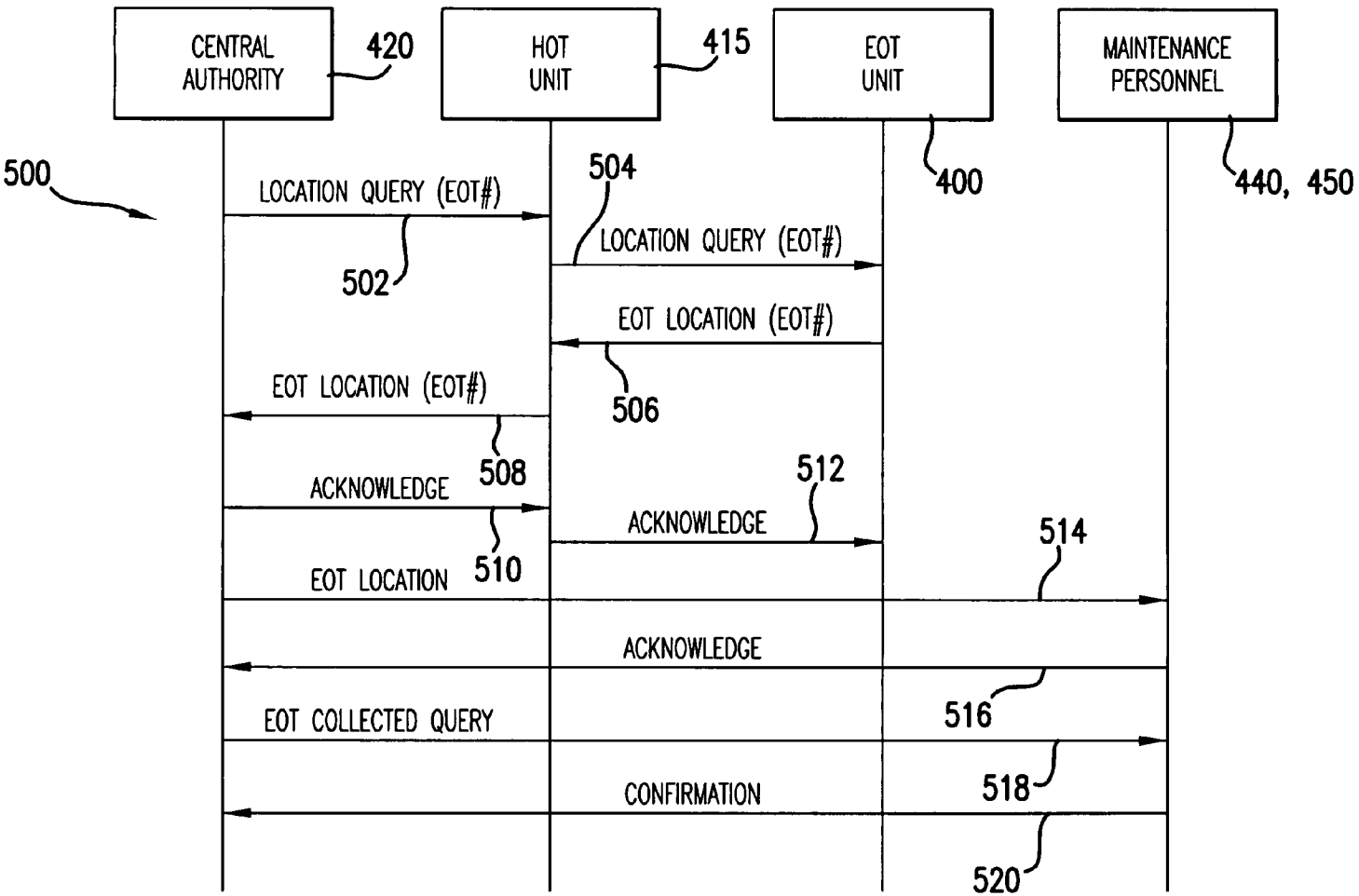
FIG. 5 is a message sequence diagram illustrating a flow of messages between components of the system of FIG. 4 according to another embodiment of the invention.

The central authority 420 is responsible for both keeping track of end of train units 400 and, more importantly, for ensuring that end of train units 400 are properly collected and/or transported by the appropriate EOT personnel. An exemplary message sequence diagram 500 illustrating message traffic in one possible transaction is illustrated in FIG. 5.

The transaction begins with the central authority 420 transmitting a location query message 502 including the identification number of a desired EOT unit via the long range communication system 426 (preferably, each of the EOT units 400 is assigned a unique identification number). When the central authority 420 has reason to believe that the EOT unit 400 of interest is coupled to a particular HOT unit 415, the message 502 may be addressed to that particular HOT unit (which also preferably have unique identification numbers). Alternatively, the message 502 may be broadcast to all HOT units 415 in the system 400. The HOT unit(s) 415 transmits a location query message 504, again including the EOT unit identification number, via the short range communication system 417. The EOT unit with the identification number in the message 504 responds by transmitting an EOT location message 506, which preferably (but not necessarily) includes the EOT unit's identification number via the short range communication system 460. The HOT unit 415 receives this message 506 via the short range communication system 417 and transmits a message 508 with the EOT location information (again, preferably including the EOT unit identification number) to the central authority via the long range communication system 418. The central authority preferably responds to the message 508 by sending an acknowledgment message 510 to the HOT unit 415, which then transmits an acknowledgment message 512 to the EOT unit 400.

It should be understood that the EOT unit 400 in the foregoing transaction may be an EOT unit attached to a train 405, or may be an EOT unit 400*a* not connected to any train. This may occur, for example, when the central authority broadcasts an EOT location message to all HOT units 415 in an attempt to locate an EOT device 400 which happens to be within communications range of an HOT device 415. It should be further understood that transaction illustrated in FIG. 5 may also begin with the transmission of an EOT location message 506 rather than with a query 502 from the central authority 420. This may occur, for example, when an EOT unit detects a condition (e.g., a tilt or a loss of brake pipe pressure) indicating that it is to go out of service and transmits its location in response to this condition.

Once the central authority 420 has successfully located the EOT unit 400 of interest, the central authority 420 ensures that the EOT unit 400 is properly attended to by the responsible EOT personnel. This may involve, for example, collecting an EOT unit 400 that has been taken off a train and laid by the wayside. The central authority 420 begins this task by transmitting an EOT location message 514 to an EOT personnel device 440, 450. The message 514 may be directed toward an EOT personnel device 440 at a fixed location via the land-based communications system 424, or may be directed toward a mobile EOT personnel device 450 via the long range communications system 426 (or possibly even a third communications system). It is also possible for the central authority to broadcast the message 514 to all EOT personnel devices in the system, which is particularly useful when the system includes mobile devices 450. The EOT location information in the message 514 may be in the form of the EOT location as provided by the positioning system in the EOT unit 400, or may be translated by the central authority 420 into a different form, such as a set of map coordinates or milepost markers. In response to the message 514, the EOT personnel device 440, 450 transmits an acknowledgment message 516 to the central authority 420. This message may be automatically generated by the EOT personnel device 440, 450 in response to the message 514, but is more preferably generated in response to an action by a human being indicating that this person has been appraised of the location of the EOT unit 400.

Once the EOT personnel device 440, 450 receives the EOT location message 514, the EOT personnel device 440, 450 preferably displays the location on a map image to facilitate location of the device by the appropriate personnel. The map image may be stored locally on the device 440, 450. Displaying the EOT unit's location on the map may require the translation of the location information from the message 514 into a different form for use with the map image. Alternatively, the central authority 420 may have preformed any necessary translation as discussed above.

In some embodiments, the central authority's job is complete once the acknowledgment message 516 is received from the EOT personnel device 440, 450. However, in other embodiments, the central authority 420 also ensures that the EOT unit 400 is properly collected. In such embodiments, the central authority 420 transmits a query 518 and repeats the transmission until a confirmation message 520 indicating that the EOT unit 400 has been attended to is received from the EOT personnel device 440, 450.

Other variations on the transaction illustrated in FIG. 5 are also possible. For example, a trainyard may be equipped with a single local EOT monitoring station 430, which may perform the tasks of locating the EOT unit 400 and notifying EOT personnel devices 440, 450 discussed above in connection with the central authority 420. In such embodiments, the local EOT monitoring stations 430 may communicate directly with the EOT units 400 using a short range communication system as shown in FIG. 4. Alternatively, the local EOT monitoring station 430 may communicate with the EOT units 400 via a long range communication system in the same manner as the central authority 420.

In yet other embodiments, a trainyard may be equipped with a plurality of local EOT unit monitoring stations 430 which may be used by a central authority with responsibility for a limited area such as a trainyard for communications with EOT units 400 rather than communicating with the EOT units 400 via the HOTs using the long range communications system 426. Still other arrangements and combinations are possible.

In some embodiments of the invention, the HOT units 415 are configured to act as "repeaters" that continue broadcasting an EOT unit location message if no acknowledgment of the message is detected by the HOT unit 415. This may occur when the EOT unit 400 has detected an out-of-service condition but has depleted its back-up battery power before its location information message was transmitted or received.

Figure 6:
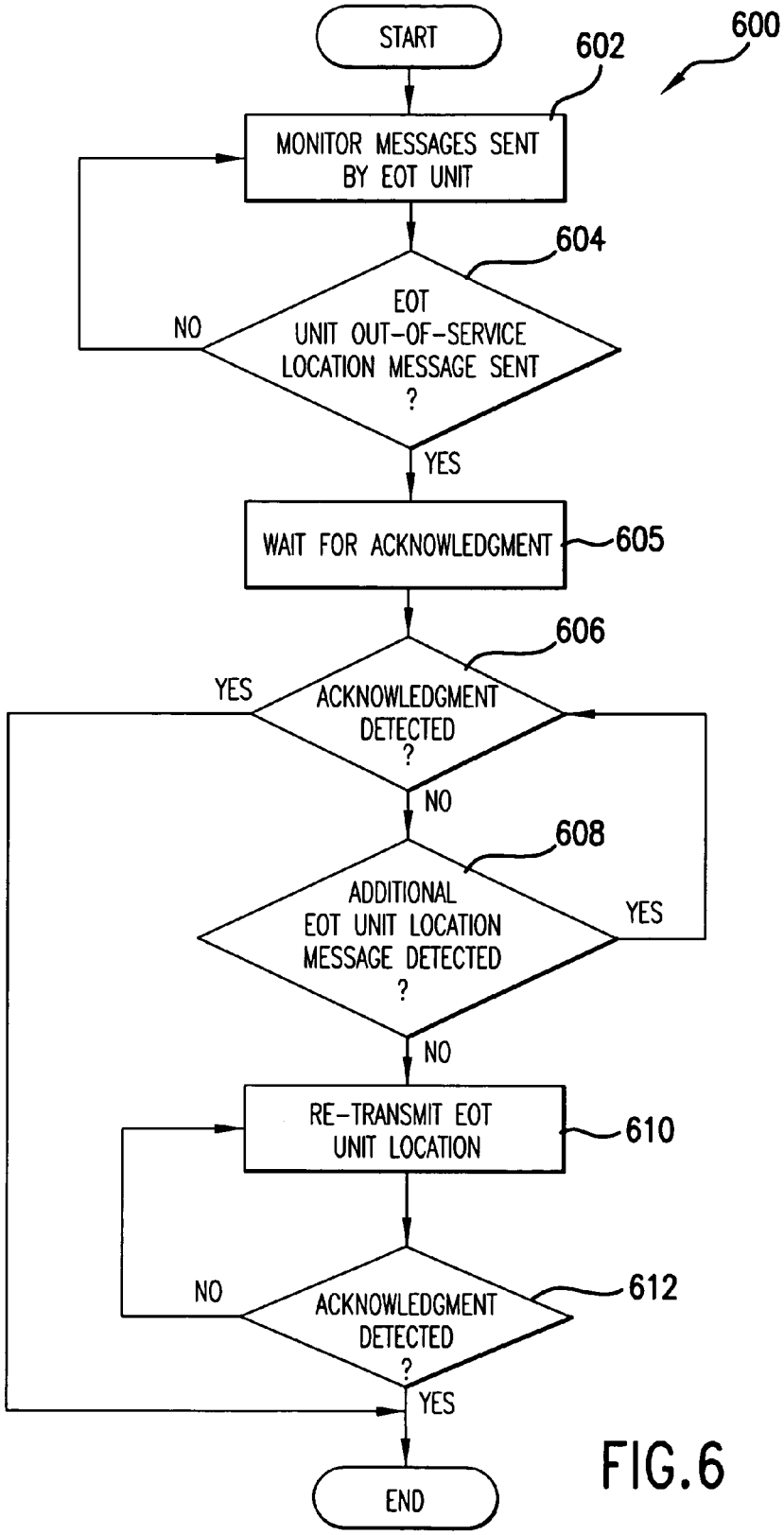
FIG. 6 is a flowchart illustrating the processing performed by one of the head of train units of FIG. 4 according to yet another embodiment of the invention.

FIG. 6 is a flowchart 600 illustrating the processing performed by such an HOT unit 415 in this aspect of the invention. The process starts with the HOT unit 415 monitoring messages sent by the EOT unit 400 at step 602. If the HOT unit 415 receives a message from the EOT unit 400 that is not a location message being sent by upon the detection of an out of service condition at step 604, the HOT unit 415 continues to monitor the EOT unit messages at step 602. If, however, the message from the EOT unit 400 is an out-of-service message at step 604, the HOT unit 415 waits a predetermined period for an acknowledgment message from some other device (e.g., the central authority 420 or a local EOT unit monitoring station 430) at step 605. The message from the EOT unit 400 may explicitly indicate an out of service condition. Alternatively, the HOT unit 415 may infer that the message from the EOT unit is an out of service condition because the message was unsolicited.

If the HOT unit 415 detects an acknowledgment message at step 606, the process ends. If no acknowledgment message is detected at step 606, the HOT unit 415 then determines whether the EOT unit 400 has transmitted another location message at step 608 (in such embodiments, the EOT units 400 may be configured to continue transmitting the location messages until an acknowledgment is received). If the EOT unit 400 has transmitted another message, step 608 is repeated. If no acknowledgment message is detected by the HOT unit 415 at step 608, the HOT unit 415 re-transmits the EOT unit location information at step 610 until an acknowledgment is detected at step 612, at which point the process ends. The message transmitted by the HOT unit 415 at step 610 may be a duplicate of the message transmitted by the EOT unit 400, which includes the EOT unit's identification number/address, thereby appearing to a recipient to have been transmitted by the EOT unit 400. Alternatively, the message transmitted by the HOT unit 415 at step 610 may include the EOT unit's identification number but may further include information identifying the HOT unit 415 as the source of the message.

It should be noted that the various embodiments of the invention discussed herein vary in significant respects with the system described in U.S. Pat. No. 6,505,104, which provides a rudimentary EOT unit tracking function. That system is primarily concerned with monitoring HOT-EOT communications and is significantly different in that respect. Additionally, the '104 patent system does not include EOT units that include positioning systems, or EOT units that recognize out of service conditions and begin transmitting location information messages in response thereto. Still further, that system does not provide the ability to query EOT units as to their location. Rather, the system of the '104 patent employs a plurality of wayside monitoring stations at known positions that simply monitor messages including EOT unit ID's that are periodically transmitted by the EOT units. The information from each of the wayside monitoring stations is then collected and cross referenced with the locations of the monitoring stations to track the EOT monitoring units as they pass by the various wayside monitoring stations.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed is:

1. An end of train unit location system comprising:

a plurality of end of train units, each of the end of train units including an end-of-train marker light;

a processor;

a transmitter connected to the processor; and a positioning system connected to the processor;

wherein the processor is configured to perform the steps of detecting a condition indicating that the end of train unit is to go out of service;

obtaining location information from the positioning system; and transmitting a message including the location information and an indicator that the end of train unit is to go out of service upon occurrence of the condition; and an end of train unit monitoring station located off of the train, the end of train monitoring station including a wireless receiver for receiving wireless messages from end of train units, the end of train monitoring station being configured to alert a user as to the location of an end of train unit when a message including location information and an indicator that one of the plurality of end of train units is to go out of service is received, thereby facilitating location of the end of train unit.

2. The end of train unit location system of claim 1, wherein the end of train units further comprise a receiver connected to the processor, and wherein the processor is further configured to repeat the transmitting step if a response to the message is not received.

3. The end of train unit location system of claim 1, wherein the end of train units further comprise a tilt sensor connected to the processor, and wherein the condition is an indication from the tilt sensor that the end of train unit has been tilted.

4. The end of train unit location system of claim 1, wherein the end of train units further comprise a transducer connected to the processor and are configured to measure air pressure in an air brake pipe of the train, and wherein the condition is an indication from the transducer that air pressure in the air brake pipe is below a threshold.

5. The end of train unit location system of claim 1, wherein the condition is an indication from an analog-to-digital converter configured to measure a voltage of a battery connected to supply power to the processor that the voltage is below a threshold.

6. The end of train unit location system of claim 1, wherein the end of train units further comprise:

a transducer connected to the processor and configured to measure air pressure in an air brake pipe of the train; and a tilt sensor connected to the processor;

wherein the condition is either an indication from the transducer that air pressure in the air brake pipe is below a threshold or an indication from the tilt sensor that the end of train unit has been tilted.

7. The end of train unit location system of claim 1, wherein the end of train units further comprise:

a transducer connected to the processor and configured to measure air pressure in an air brake pipe of the train; and a tilt sensor connected to the processor;

wherein the condition comprises concurrent indications from the transducer and the tilt sensor that air pressure in the air brake pipe is below a threshold and that the end of train unit has been tilted.

8. The end of train unit location system of claim 1, wherein the processor is further configured to perform the steps of:

obtaining a plurality of positions from the positioning system; and transmitting a message indicating whether or not the train is in motion based on the plurality positions from the positioning system.

9. The end of train unit location system of claim 1, wherein the message including the location information is received directly from one of the plurality of end of train units by the end of train unit monitoring station.

10. The end of train unit location system of claim 1, wherein the message including the location information is transmitted to the end of train unit monitoring station via a device at the head of the train.

11. The end of train unit location system of claim 10, wherein the message is transmitted to the device at the head of the train with the transmitter and the message is transmitted from the head of the train to the end of train unit monitoring station using a communication system of a type different from a type of the transmitter.

12. The end of train unit location system of claim 1, wherein the processor is further configured to perform the steps of:

obtaining a plurality of positions from the positioning system;

calculating a speed of the train based on the plurality of positions from the positioning system; and transmitting a message indicating the speed.

13. The end of train unit of claim 1, wherein the power supply subsystem comprises a battery.

14. The end of train unit of claim 1, wherein the power supply subsystem comprises an air-powered electrical generator.

15. The system of claim 1, wherein the user is alerted by a display of the EOT location superimposed over a map.

16. The system of claim 1, wherein the user is alerted by sending a message indicating the location of the EOT unit from the end of train monitoring station to personnel responsible for locating the EOT unit.

17. A method for facilitating the location of an end of train unit comprising the steps of:

detecting at the end of train unit a condition indicating that the end of train unit is to go out of service, the end of train unit including an end-of-train marker light;

obtaining location information for the end of train unit from a positioning system;

transmitting a message from the end of train unit including the location information and an indicator that the end of train unit is to go out of service upon occurrence of the condition;

receiving the message at an end of train monitoring station located off of a train; and alerting a user as to the location of the end of train unit upon receipt of the message, thereby facilitating location of the end of train unit.

18. The method of claim 17, further comprising the step of repeating the transmitting step if a response to the message is not received.

19. The method of claim 17, wherein the condition is an indication that the end of train unit has been tilted.

20. The method of claim 17, wherein the condition is an indication that a battery voltage is below a threshold.

21. The method of claim 17, wherein the condition is an indication that an air pressure in an air brake pipe of the train is below a threshold.

22. The method of claim 17, wherein the condition is either an indication that air pressure in an air brake pipe on the train is below a threshold or an indication that the end of train unit has been tilted.

23. The method of claim 17, wherein the condition comprises an indication that a battery voltage is below a threshold and an indication that the end of train unit has been tilted and an indication that an air pressure in an air brake pipe of the train is below a threshold.

24. The method of claim 17, wherein the condition comprises concurrent indications that an air pressure in an air brake pipe of the train is below a threshold and that the end of train unit has been tilted.

25. The method of claim 17, further comprising the steps of:

obtaining a plurality of positions of the train from a positioning system; and transmitting a message indicating whether or not the train is in motion based on the plurality of positions.

26. The method of claim 25, wherein the alerting step is performed by displaying the EOT location superimposed over a map.

27. The method of claim 25, wherein the alerting step is performed by sending a message indicating the location of the EOT unit to personnel responsible for locating the EOT unit.

28. The method of claim 17, further comprising the steps of:

obtaining a plurality of positions from the positioning system;

calculating a speed of the train based on the plurality of positions; and transmitting a message indicating the speed.

29. The method of claim 28, wherein the message is transmitted to the end of train unit monitoring station via a device at a head of the train.

30. The method of claim 29, wherein the message is received directly from one of the plurality of end of train units by the end of train unit monitoring station.

31. A method for facilitating the tracking of an end of train unit comprising the steps of:

monitoring at an end of train unit a pressure in an air brake pipe of a train on which the end of train unit is mounted, the end of train unit including an end-of-train marker light;

obtaining a position of the end of train unit from a positioning system; and transmitting the position to an end of train unit monitoring station located off of a train when the pressure falls below a thresholds;

alerting a user as to the location of the end of train unit upon receipt of the message, thereby facilitating location of the end of train unit.

32. A method for facilitating the tracking of an end of train unit comprising the steps of:

detecting at an end of train unit when the end of train unit has been tilted, the end of train unit including an end-of-train marker light;

obtaining a position of the end of train unit from a positioning system; and transmitting the position to an end of train unit monitoring station located off of a train when the end of train unit has been tilted;

alerting a user as to the location of the end of train unit upon receipt of the message, thereby facilitating location of the end of train unit.

33. A method for facilitating the locating of an end of train unit comprising the steps of:

transmitting a first message from an end of train unit monitoring station located off of a train to the end of train unit, the end of train unit including an end-of-train marker light;

receiving a second message in response to the first message, the second message indicating a location of the end of train unit at the end of train unit monitoring station; and alerting a user as to the location of an end of train unit in response to receipt of the message, thereby facilitating location of the end of train unit.

34. The method of claim 33, wherein the end of train unit comprises a global positioning system receiver and the location is based on information from the global positioning system receiver.

35. The method of claim 33, wherein the first message transmitted by the end of train unit monitoring station is received via a device at a head of a train and wherein the second message is transmitted from the end of train unit to the device at the head of the train and subsequently transmitted from the device at the head of the train to the end of train unit monitoring station.

36. The method of claim 33, wherein the first message is transmitted at a time when the end of train device is not connected to the train.

37. An end of train unit tracking device comprising:

a processor;

a receiver connected to the processor;

a transmitter connected to the processor; and a memory connected to the processor;

wherein the processor is configured to perform the steps of receiving a message including a location of an end of train unit, the end of train unit including a end-of-train marker light; and transmitting a first message including the location of the end of train unit to an entity located off of a train and responsible for locating the end of train device.

38. The device of claim 37, wherein the processor is further configured to perform step of transmitting a second message upon a failure to receive an indication that the end of train device has been located.

39. The device of claim 38, wherein the second message is transmitted to the same entity as the first message.

40. The device of claim 38, wherein the second message includes the location of the end of train device.

41. A device located off of a train for aiding a person in locating an end of train unit, the device comprising:

a processor;

a database connected to the processor, the database including map data suitable for displaying a map;

a receiver connected to the processor; and a display connected to the processor;

wherein the processor is configured to perform the steps of receiving a message including a location of an end of train unit, the end of train unit including a end-of-train marker light, the message indicating that the end of train unit is to go out of service; and displaying, in response to receipt of the message, a map including an indication as to the location of the end of train unit on the display.

42. The device of claim 41, further comprising a housing, the processor, database, receiver and display being positioned inside the housing, the housing being of a size suitable for hand-held operation.

43. The method of claim 41, wherein the information from the positioning system comprises a plurality of positions.

44. The method of claim 41, wherein the information from the positioning system comprises a speed supplied by the positioning system.

* * * * *